US008634753B2

(12) United States Patent
Omata

(10) Patent No.: US 8,634,753 B2
(45) Date of Patent: Jan. 21, 2014

(54) IMAGE FORMING APPARATUS OPERABLE IN MODES USING A FIXING DEVICE WITH/WITHOUT A GLOSSING DEVICE

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 12/884,508

(22) Filed: Sep. 17, 2010

(65) Prior Publication Data

US 2011/0076073 A1 Mar. 31, 2011

(30) Foreign Application Priority Data

Sep. 28, 2009 (JP) ..... 2009-222318
Jul. 22, 2010 (JP) ..... 2010-164687

(51) Int. Cl.
*G03G 15/20* (2006.01)

(52) U.S. Cl.
USPC ..... 399/341

(58) Field of Classification Search
USPC ..... 399/341, 342
See application file for complete search history.

(56) References Cited

U.S. PATENT DOCUMENTS 5,234,783 A 8/1993 Ng
5,260,753 A * 11/1993 Haneda et al.
5,895,153 A 4/1999 Aslam et al.
7,515,848 B2 4/2009 Kitozaki
7,542,707 B2 6/2009 Omata
2006/0051114 A1 3/2006 Ng
2006/0133870 A1 6/2006 Ng et al.
2006/0188301 A1* 8/2006 Ng et al. ..... 399/341
2006/0198660 A1* 9/2006 Bessho
2006/0210295 A1 9/2006 Nakaya et al.
2007/0059033 A1 3/2007 Kitozaki
2007/0127940 A1 6/2007 Zaima (Continued)

FOREIGN PATENT DOCUMENTS

EP 1615080 A1 1/2006
JP 10055085 A * 2/1998

(Continued)

OTHER PUBLICATIONS

Communication dated Feb. 10, 2011, forwarding a European Search Report dated Feb. 3, 2011, in counterpart European Application No. 10180012.6-2009.

(Continued)

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image forming apparatus includes a transparent image forming device for forming a transparent toner image on a sheet with a transparent toner in an amount per unit area; a manual selector for selecting an image area in which the transparent toner image is to be formed and for selecting the amount per unit area; a heating device for heating the transparent toner image formed on the sheet; a glossing device for processing the transparent toner image formed on the sheet so that glossiness is higher than that by the heating device; a mode selector for selecting a first mode in which the glossing device is not used and a second mode in which the glossing device is used; and a controlling device for controlling the amount per unit area of the transparent toner in the image area so as to be not less than a predetermined amount in the second mode.

4 Claims, 12 Drawing Sheets

(56) References Cited

U.S. PATENT DOCUMENTS

| | | | | |
|---|---|---|---|---|
| 2008/0124154 | A1* | 5/2008 | Ishiduka | 399/341 |
| 2008/0298860 | A1 | 12/2008 | Omata | |
| 2009/0034998 | A1 | 2/2009 | Omata | |

FOREIGN PATENT DOCUMENTS

| | | | | |
|---|---|---|---|---|
| JP | 11-242398 | A | | 9/1999 |
| JP | 2004-151269 | A | | 5/2004 |
| JP | 2007108585 | A | * | 4/2007 |
| JP | 2009229836 | A | * | 10/2009 |
| RU | 2006132433 | A | | 3/2008 |
| RU | 2370802 | C2 | | 10/2009 |

OTHER PUBLICATIONS

Notification of the First Office Action dated Dec. 31, 2011, in Chinese Application No. 201010293990.4.
Decision on Grant—A Patent for Invention dated Nov. 17, 2011, in Russian Application No. 2010139724/28.
Notice of Preliminary Rejection mailed Oct. 22, 2012, in Korean Application No. 10-2010-0093240.

* cited by examiner (a)

(b)

(a)

(b)

(a)

(b)

(c)

IMAGE FORMING APPARATUS OPERABLE IN MODES USING A FIXING DEVICE WITH/WITHOUT A GLOSSING DEVICE

FIELD OF THE INVENTION AND RELATED ART

The present invention relates to an image forming apparatus for forming an image on a recording material by using toner.

In recent years, the image forming apparatus for forming an image on a sheet by using chromatic toners (color toners) of yellow, magenta, cyan, black, and the like and using the transparent toner which is colorless and transparent has been proposed. By the use of the transparent toner, compared with the case where the transparent toner is not used, a range of representation of a print to be output is extended. For example, by forming a transparent toner image on the entire surface of the sheet, glossiness on the entire surface of the sheet can be increased uniformly. Further, it is possible to form characters or (graphic) patterns, such as a watermark which is also called a gloss mark or a security mark, on the sheet. Specifically, the transparent toner image is formed on a part of the sheet, so that the glossiness on the part of the sheet is increased relative to a remaining part of the sheet. As a result, an intentional difference in glossiness is provided between an area (gloss mark portion) in which the transparent toner image is formed and an area except the area (gloss mark portion), so that the area (gloss mark portion) in which the transparent toner image is formed can be made conspicuous.

Further, as a method of enhancing the glossiness of the print to be output like that of silver halide photography, a method using the transparent toner and a belt fixing device (glossing device or gloss processing device) of a cooling separation type has been known. For example, Japanese Laid-Open Patent Application (JP-A) Hei 11-242398 discloses a glossing device in which a sheet on which a toner image is formed is heated by a fixing belt having a smooth surface at which the glossiness is high and then the sheet is brought into intimate contact with the fixing belt and is cooled and then is separated. In this way, the heated toner is separated after being solidified while being in intimate contact with the belt, so that the toner image surface processed by the glossing device has high glossiness comparable to that at the surface of the fixing belt.

Here, by designating that the transparent toner image is formed in a specified amount at a specified position of the sheet, it is possible to form a gloss mark having a desired shape and desired glossiness and to uniformize the glossiness on the entire sheet surface. For this reason, a user has designated the position in which the transparent toner image is to be formed and an amount (per unit area) of the transparent toner as image data for the transparent toner. Specifically, by using the image data for the transparent toner, the user has designated the transparent toner image forming position and the transparent toner amount with gradation and resolution comparable to those for a chromatic (color) toner image.

Thus, by using the image data for the transparent toner, it is possible to adjust the transparent toner amount (a weight per unit area) in order to effect gradation representation with the glossiness. That is, the image forming apparatus forms the transparent toner image on the sheet in a designated amount in accordance with the image data for the transparent toner prepared by the user.

However, the present inventor found that when the transparent toner image formed on the sheet in this way was processed by the glossing device, image defects occurred in an area in which the transparent toner image was formed in the amount per unit area which was less than a predetermined amount (per unit area). Specifically, the present inventor found that image defects, such as bubbles or cavities, occurred in the area in which the transparent toner image was formed in the amount per unit area which was less than the predetermined amount.

SUMMARY OF THE INVENTION

A principal object of the present invention is to provide an image forming apparatus capable of preventing an occurrence of the above-described image defect.

According to an aspect of the present invention, there is provided an image forming apparatus comprising:

a transparent image forming device for forming a transparent toner image on a sheet with a transparent toner in an amount per unit area;

a manual selector for selecting an image area in which the transparent toner image is to be formed and for selecting the amount per unit area;

a heating device for heating the transparent toner image formed on the sheet;

a glossing device for processing the transparent toner image formed on the sheet so that glossiness is higher than that by the heating device;

a mode selector for selecting a first mode in which the glossing device is not used and a second mode in which the glossing device is used; and a controlling device for controlling the amount per unit area of the transparent toner in the image area so as to be not less than a predetermined amount in the second mode.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Image Forming Portion

Figure 1A:
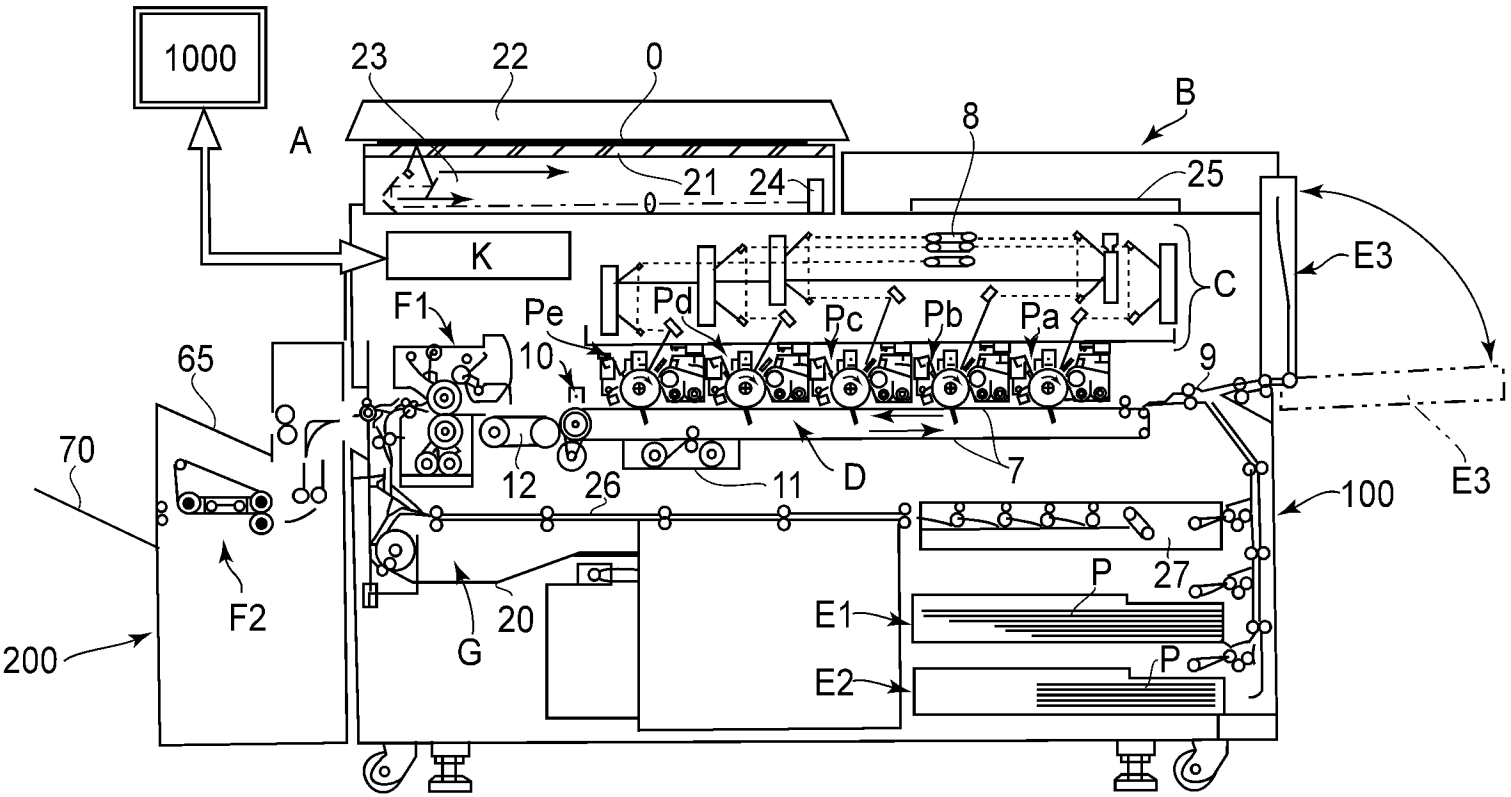
FIG. 1A is a schematic view showing a structure of an image forming apparatus in Embodiment 1.
Figure 1B:
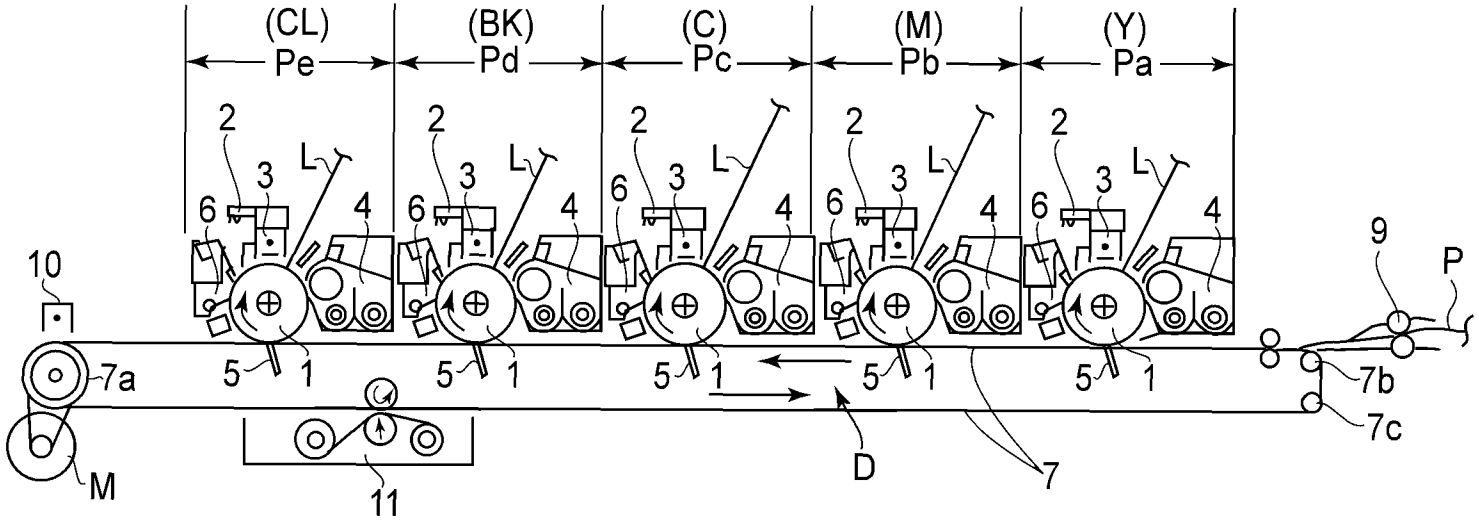
FIG. 1B is a partially enlarged view of FIG. 1A.
Figure 2A:
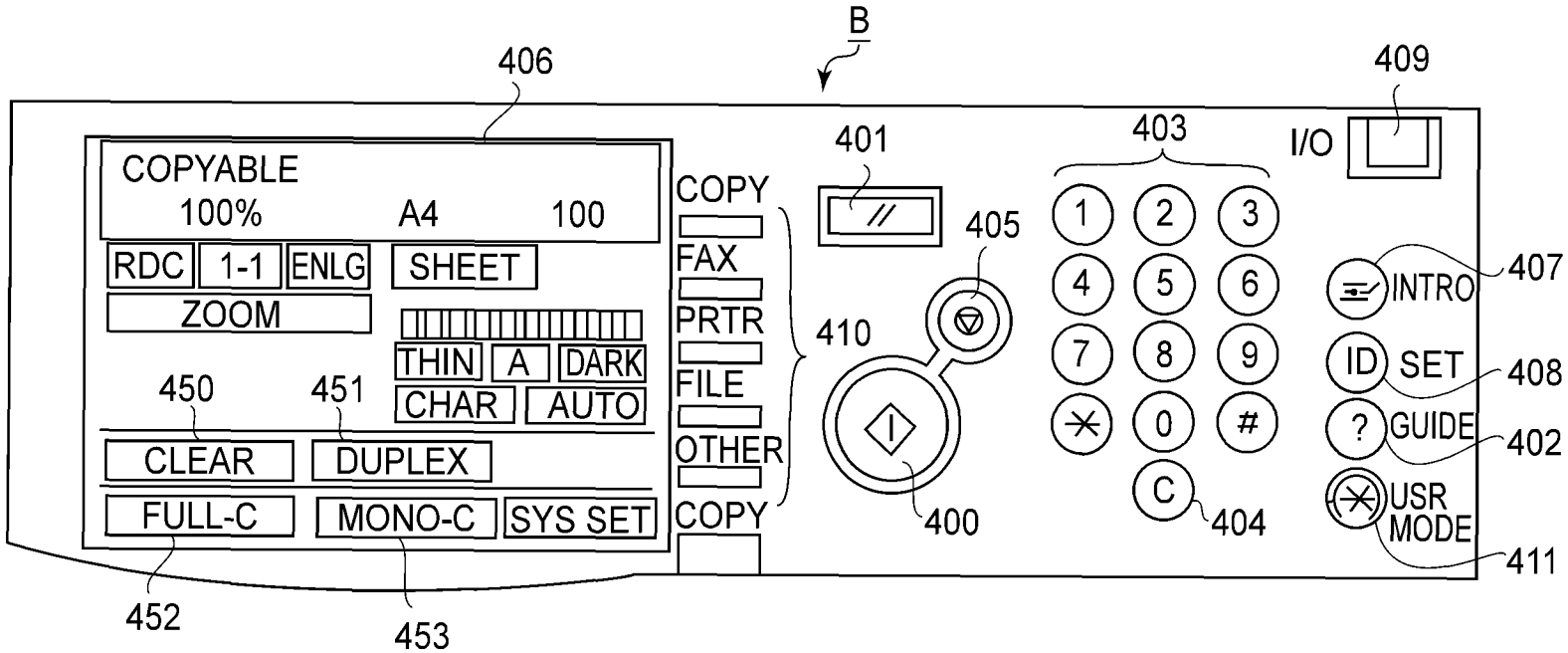
FIG. 2A is a plan view of an operating display portion.
Figure 2B:
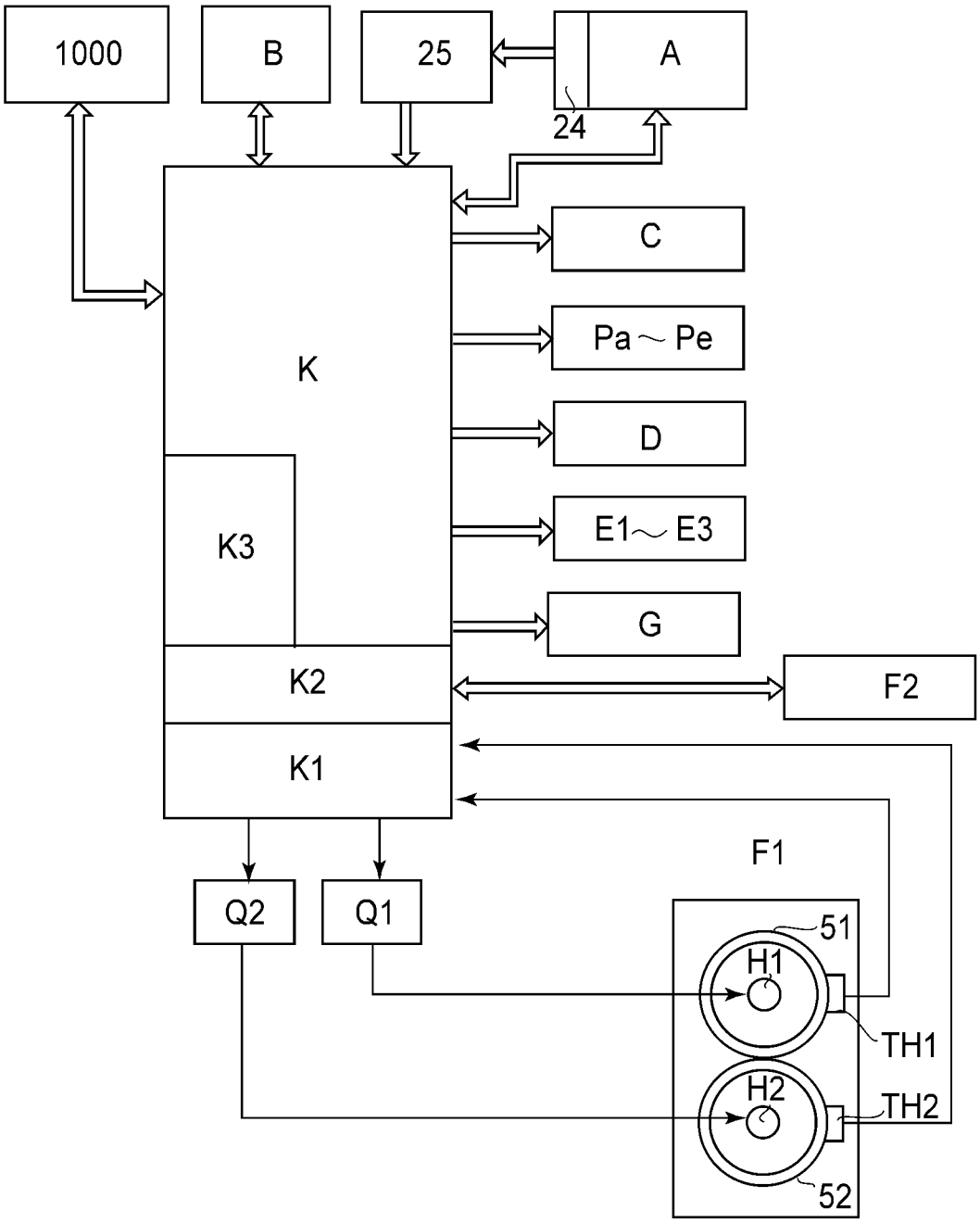
FIG. 2B is a schematic block diagram of a control system.
Figure 3:
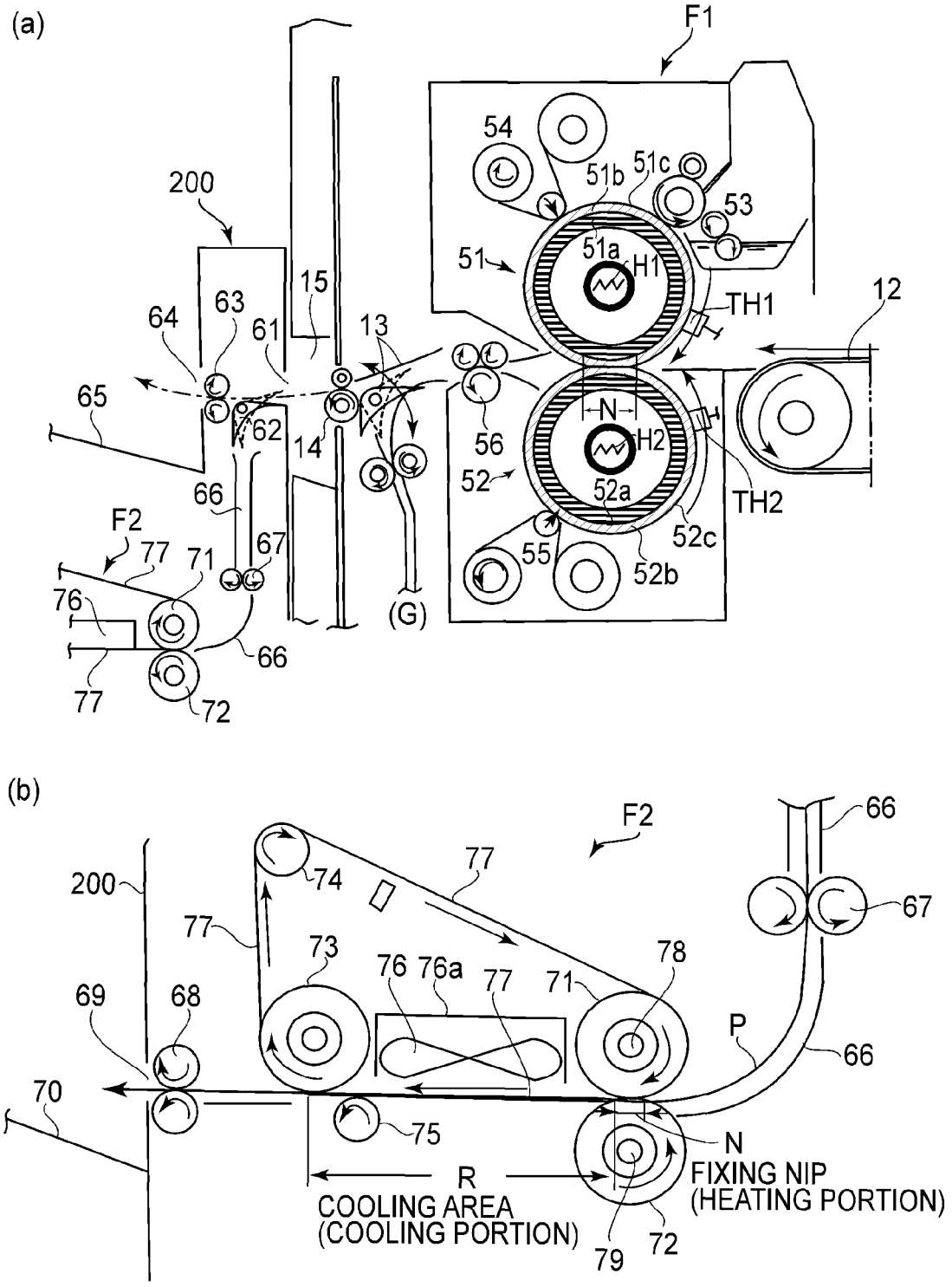
FIG. 3(*a*) is a schematic view showing a structure of a fixing device F1, and FIG. 3(*b*) is a schematic view showing a structure of a fixing device F2.

FIG. 1A is a schematic view showing a structure of an image forming apparatus (image forming system) in this embodiment, and FIG. 1B is a partially enlarged view of FIG. 1A. FIG. 2A is a plan view of an operating display portion (operating panel portion or operating portion), and FIG. 2B is a schematic block diagram of a control system. FIG. 3(*a*) is an enlarged cross-sectional view of a heat roller fixing device portion, and FIG. 3(*b*) is an enlarged cross-sectional view of a belt fixing device portion. The image forming apparatus in this embodiment is an electrophotographic full-color digital image forming apparatus of a five-drum type (tandem type), and is a multifunction machine functioning as a copying machine, a printer, and a facsimile machine.

Reference character K represents a controller (control circuit portion or controller substrate portion) which effects centralized control of the image forming apparatus. Reference numeral 1000 represents an external input device (external host device), such as a personal computer or facsimile machine, and is electrically connected to the controller K through an interface.

Inside an apparatus main assembly 100, first to fifth (five) electrophotographic image forming portions Pa, Pb, Pc, Pd, and Pe, respectively, are disposed in the horizontal direction from left to right in FIG. 1A. In the image forming apparatus in this embodiment, each of the image forming portions Pa, Pb, Pc and Pd is an image forming means for forming a color toner image on a recording material by using a color toner. Further, the image forming portion Pe is an image forming means for forming a transparent toner image on the recording material by using a transparent toner. Reference characters A and B represent an original reading portion (image scanner) and an operating display portion, respectively. The original reading portion A reads an original O placed on an original supporting glass platen 21 by color-separation photoelectric reading of an original image through optical scanning. The operating display portion B performs command input from an operator, an apparatus state notification to the operator, and so on.

Reference character C represents a laser scanning mechanism (laser scanner) which is disposed on an upper side of the image forming portions Pa, Pb, Pc, Pd and Pe and which has multiple optical scanning means. Reference character D represents a transfer belt system which disposed on a lower side of the image forming portions Pa, Pb, Pc, Pd, and Pe. Reference characters E1 and E2 represent first and second sheet feeding cassettes (cassette sheet feeding portions) which are vertically stacked in two (upper and lower) stages below the transfer belt system D. Reference character E3 represents a manual sheet feeding tray (manual sheet feeding portion) which can be folded up with respect to the apparatus main assembly 100 as indicated by a solid line. When it is in use, it is opened down as indicated by a chain double-dashed line. Reference character F1 represents a heat roller fixing device, as a first fixing means, which is disposed on the downstream side of the transfer belt system D with respect to a recording material conveyance direction. A reference numeral 200 represents a belt fixing unit disposed adjacent to the apparatus main assembly 100 on a recording material discharge opening side, in which a belt fixing device F2 as a second fixing means is incorporated. The first fixing means F1 and the second fixing means F2 are fixing means different in glossiness of output products (fixed image-formed products), and the second fixing means F2 is the fixing means capable of fixing an image with glossiness which is higher than that by the first fixing means F1.

At the original reading portion A, reference numeral 21 represents an original supporting platen glass, and reference numeral 22 represents an original pressing plate which can be opened or closed relative to the original supporting platen glass 21. In the case of a copy mode (original copying mode), a color original O (or a monochromatic original) is placed on the glass 21, in accordance with a predetermined original placement requirement, with its image surface downward. Then, the original O is covered with the plate 22, so that the original O is set. The plate 22 may also be replaced with an automatic original feeding device (ADF, RDF) so as to be configured to automatically feed the original in the form of a sheet onto the glass 21. Then, after a desired copying condition is set by the operator by operating the operating display portion B, a copy start key 400 (FIG. 2A) is pressed. As a result, a movable optical system 23 is moved and driven along a lower surface of the glass 21, so that the downward image surface of the original O on the glass 21 is optically scanned. Reflected light of the original scanning is focused on a CCD 24 which is a photoelectric transducer solid-state image pick-up device, and is subjected to color-separation reading with three primary colors of RGB (red, green and blue). The thus read signals of RGB are input into an image processing portion 25. Then, electrical image information processed by the image processing portion is input into a controller K. The controller K controls the laser scanning mechanism C so as to output laser light modulated correspondingly to the electrical image information, to each of the image forming portions Pa, Pb, Pc, Pd and Pe.

In the case of a printer mode, the electrical image information is input from a personal computer which is the host device 1000 into the controller K of the apparatus main assembly 100, so that the image forming apparatus functions as a printer.

In the case of a facsimile reception mode, the electrical image information is input from a remote-side facsimile machine which is the host device 1000 into the controller K of the apparatus main assembly 100, so that the image forming apparatus functions as a facsimile receiving machine.

Each of the image forming portions Pa, Pb, Pc, Pd, and Pe is the same electrophotographic process mechanism. That is, each image forming portion includes an electrophotographic photosensitive drum 1 (hereafter referred to similar as a drum) as an image bearing member. Further, each image forming portion includes process means acting thereon, such as a whole surface exposure lamp 2 (charge removal lamp), a primary charger 3, a developing device 4, a transfer charger 5, and a drum cleaner 6, etc. To the developing device 4 of the first image forming portion Pa, a yellow (Y) toner is supplied by a (toner) supplying device. To the developing device 4 of the second image forming portion Pb, a magenta (M) toner is supplied by a supplying device. To the developing device 4 of the third image forming portion Pc, a cyan (C) toner (developer) is supplied by a supplying device. To the developing device 4 of the fourth image forming portion Pd, a black (Bk) toner is supplied by a supplying device. To the developing device 4 of the fifth image forming portion Pe, transparent toner which is clear (CL) or transparent (T) is supplied by a supplying device.

The transfer belt system D includes an endless transfer belt 7, a driver roller 7*a*, a turn roller 7*b*, and a turn roller 7*c*. The transfer belt 7 is extended around and stretched by the rollers 7*a*, 7*b*, and 7*c*. The roller 7*a* is rotationally driven by a driving motor M through a power (driving force) transmitting apparatus, such as a timing belt device, so that the belt 7 is rotationally moved in the counterclockwise direction indicated by an arrow at a predetermined speed. The belt 7 is constituted by a dielectric resin sheet, such as a polyethylene-terephthalate resin sheet (PET resin sheet), polyfluorovinylidene resin sheet, polyurethane resin sheet, or the like. As the belt, a belt prepared by superposing and bonding end portions of the sheet in an endless shape or a (seamless) belt free from a seam is used. Reference numeral 11 represents a cleaning device for cleaning the surface of the belt 7.

An operation of the apparatus for outputting the image-formed product by using the four color toners of Y, M, C and Bk and the transparent toner will be described. The respective image forming portions Pa, Pb, Pc, Pd and Pe are sequentially driven with predetermined control timing. By this driving force, the drum 1 at each of the image forming portions rotates in the clockwise direction indicated by an arrow. Further, the transfer belt 7 of the transfer belt mechanism D is also rotationally driven. Further, the laser scanning mechanism C is also driven. In synchronism with the driving of these components, the primary charger 3 at each of the image forming portions uniformly charges the drum 1 to a predetermined polarity and a predetermined potential. The laser scanning mechanism C subjects the surface of the drum 1 at each of the image forming portions to scanning exposure with a laser beam L which depends on the image signal. As a result, an electrostatic image which depends on the image signal is formed on the surface of the drum 1 at each of the image forming portions. More specifically, the laser scanning mechanism C scans the surface of the drum 1 with the laser light emitted from its light source device by rotating a polygon mirror 8, which is being rotated. A flux of the scanning light is deflected by a reflection mirror and is focused on the generatrix of the drum 1 by f-θ lens to perform the light exposure. As a result, the electrostatic image which depends on the image signals is formed on the drum 1. The formed electrostatic image is developed into a toner image by the developing device 4. By the electrophotographic process operation as described above, a yellow (Y) toner image, which corresponds to the yellow component of the full-color image, is formed on the peripheral surface of the drum 1 at the first image forming portion Pa. A magenta (M) toner image, which corresponds to the magenta component of the full-color image, is formed on the peripheral surface of the drum 1 at the second image forming portion Pb. A cyan (C) toner image, which corresponds to the cyan component of the full-color image, is formed at the peripheral surface of the drum 1 at the third image forming portion Pc. A black (Bk) toner image, which corresponds to the black component of the full-color image, is formed on the peripheral surface of the drum 1 at the fourth image forming portion Pd. Finally, formation of (clear) transparent toner image is effected at the fifth image forming portion Pe.

Meanwhile, a sheet feeding roller of the sheet feeding portion which is selected and designated from the first sheet feeding cassette E1, the second sheet feeding cassette E2, and the manual sheet feeding tray E3 is driven. As a result, the sheets of the recording material P which have been stacked and accommodated in the selected sheet feeding portion are separated and fed one by one. Then, the recording material P is supplied onto the transfer belt 7 of the belt mechanism D through a plurality of conveying rollers and registration rollers 9. The recording material P supplied onto the belt 7 is conveyed successively to transfer portions of the respective image forming portions by the conveyance of the belt 7. The transfer portion at each image forming portion is a contact portion between the drum 1 and the belt 7.

When the belt 7 is rotationally driven and it is confirmed that the belt 7 is located at a predetermined position, the recording material P is sent from the registration rollers to the belt 7. At the same time, an image writing start signal is turned on and on the basis thereof, image formation on the drum of the first image forming portion Pa is effected with preset control timing. Then, at the transfer portion on the lower surface side of the drum 1, the transfer charger 5 imparts an electric field or electrical charges, so that the first yellow (Y) toner image is transferred onto the recording material P. By this transfer, the recording material P is firmly held on the belt 7 by an electrostatic attraction force and then is sequentially conveyed through the transfer portions of the second to fifth image forming portions Pb, Pc, Pd and Pe. Thus, the recording material P is subjected to successive superimposing transfers of the respective toner images of magenta (M), cyan (C), black (Bk), and transparent (T) which have been formed on the drums at the image forming portions Pb, Pc, Pd and Pe. As a result, an unfixed full-color image consisting of four toner images of yellow (Y), magenta (M), cyan (C) and black (Bk) and the transparent toner image of transparent (T) are synthetically formed on the recording material P.

The recording material P is separated from the belt 7 by charge removal by using a separation charger 10 and then introduced into the fixing device F1 by a conveyer belt 12.

In this embodiment, the fixing device F1 is the heat roller fixing device as shown in FIG. 3(*a*). The recording material P which is introduced into the fixing device F1 enters a fixation nip N which is a press-contact portion between a fixing roller 51 and a pressing roller 52, thus being nip-conveyed through the fixation nip N. As a result, the recording material P is subjected to heat and pressure, so that the fixation of the toner images on the recording material P is performed. The recording material P after passing through the nip N is conveyed by fixation sheet discharging rollers 56 and passes through an upper side of a selector 13, which have been switched into a first attitude indicated by a solid line in FIG. 3(*a*) is relayed by discharging rollers 14, and then, enters a recording material entrance 61 of a belt fixing unit 200 from a discharge opening 15. In the case where the image forming mode is a medium gloss mode (first mode) of a transparent mode in which the color toners and the transparent toner are used, a second selector 62 on the unit 200 side has been switched into the first attitude indicated by a solid line in FIG. 3(*a*). The recording material P which has entered the unit 200 passes through the upper side of the second selector 62 in the first attitude, is relayed by discharging rollers 63, and then is discharged onto a first discharging tray 65 from a discharging opening 64. That is, a medium-gloss transparent image-formed product is output. Further, in the case where the image forming mode is a high gloss mode of the transparent mode in which the color toners and the transparent toner are used, the second selector 62 on the unit 200 side has been switched into a second attitude indicated by a broken line in FIG. 3(*a*). Further, the recording material P which has entered the unit 200 is turned downward by the second selector 62 in the second attitude and is introduced into the fixing device F2 by a guide plate 66 and conveying rollers 67. The recording material P which has passed through the fixing device F2 is relayed by discharging rollers 68 and is discharged onto a discharging tray 70 from a discharging opening 69. That is, a high-gloss image-formed product is output. The fixing device F2 which is the second fixing means is capable of fixing the image with glossiness which is higher than that by the fixing device F1 which is the first fixing means. The high gloss mode (second transparent mode) is an image forming mode in which a silver halide photography-like image with glossiness which is higher than that in the medium gloss mode (first transparent mode) is obtained. Further, in the case where a non-transparent mode in which the transparent toner is not used, at the fifth image forming portion Pe for forming the transparent image, the rotational drive of the drum 1 is performed but the image forming operation is not performed. Then, the recording material P which has come out of the fixing device F1 while carrying thereon the non-transparent image is discharged onto the first discharging tray and is not introduced into the fixing device F2.

It is also possible to output a monochromatic (single color) image-formed product. In this case, only the image forming portion, among the first to fifth image forming portions Pa, Pb, Pc, Pd, and Pe, which corresponds to the selected image forming mode, performs the image forming operation. At the other image forming portions, the image forming operation is not performed although the rotation drive of the drums 1 is performed. In the case where a double-sided image forming mode is selected, the image forming operation is as follows. In the apparatus main assembly 100, the recording material P which has come out of the fixing device F1 is turned toward a reverse sheet re-feeding mechanism G side by the first selector switched into a second attitude indicated by a broken line in FIG. 3(*a*). Then, the recording material P is subjected to switchback conveyance by a reversing portion 20 (switchback mechanism; FIG. 1A) of this mechanism G and is sent to a double-sided conveying path 26, thus being once accommodated in an intermediary tray 27. The recording material P accommodated in the tray 27 is fed from the tray 27 toward the registration rollers 9 by a sheet feeding roller which is driven with predetermined control timing. From the registration rollers 9, the recording material P is fed again onto the belt 7 of the mechanism D with its second surface upward. Then, similarly as in the case of the image formation on the first surface, the toner image formation on the second surface is effected at the image forming portions. The recording material P which has been subjected to the toner image formation on the second surface is separated from the belt 7 and is conveyed into the fixing device F1, in which the recording material P is subjected to toner image fixation on the second surface.

<Operating Display Portion>

Figure 4:
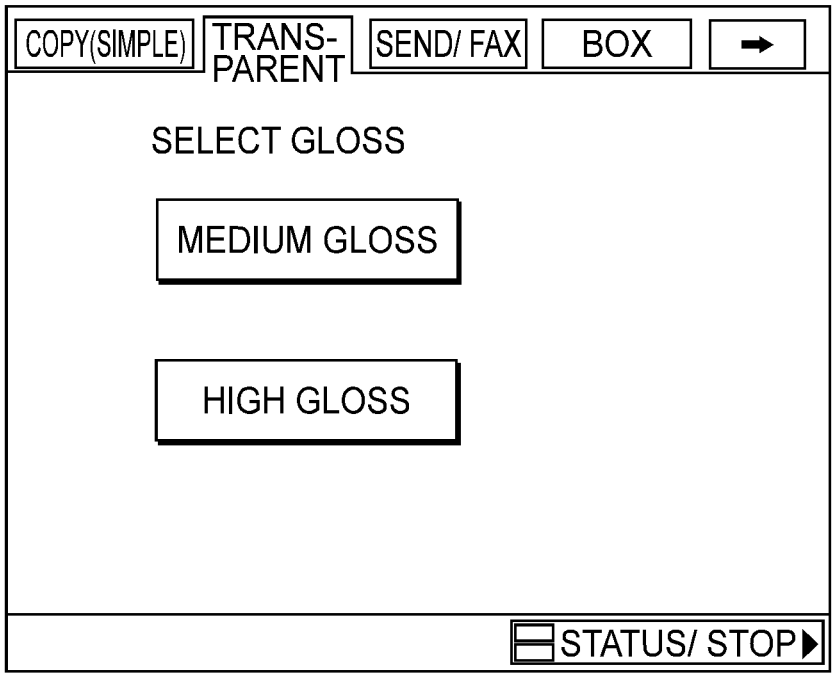
FIG. 4(*a*) is a schematic view showing a touch panel indicating selection operation buttons for a medium gloss mode and a high gloss mode in a transparent mode, and FIG. 4(*b*) is a graph showing relationship between a toner amount and glossiness with respect to the fixing device F1 in Embodiment 1.
Figure 4:
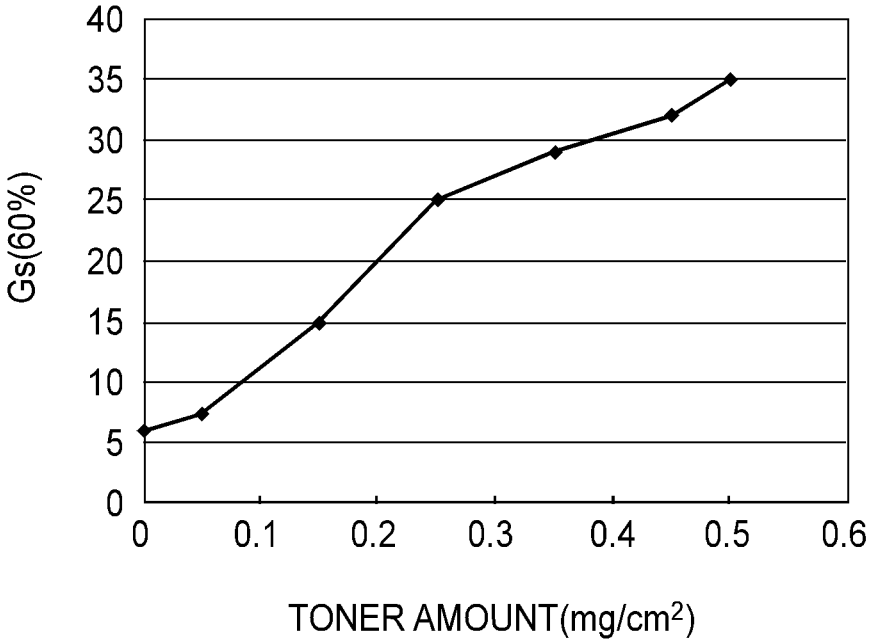

In the operating display portion B shown in FIG. 2A, reference numeral 400 denotes a copy start key for providing an instruction to start a copying operation. Reference numeral 401 denotes a reset key for returning the operation mode of the image forming apparatus to a normal mode. Reference numeral 402 denotes a guidance key which is to be pressed when a guidance function is used. Reference numeral 403 denotes a group of numerical keys to be used to input a numerical value, such as a pre-set number of sheets. Reference numeral 404 denotes a clear key for clearing the input numerical value. Reference numeral 405 denotes a stop key for interrupting the copying operation during continuous copying. Reference numeral 406 denotes a liquid crystal display portion which displays settings of various operational modes or a printer state and is also a touch panel. Reference numeral 407 denotes an interruption key for interrupting the continuous copying operation, a faxing operation, or a printing operation to perform an urgently needed copying. Reference numeral 408 denotes a password key for controlling the copy count for each user, each section, or the like. Reference numeral 409 denotes a soft switch for turning on or off the electrical power source of the apparatus main assembly 100. Reference numeral 410 denotes a function key to be used to change the function of the image forming apparatus. Reference numeral 411 denotes a user mode key for entering a user mode in which a user pre-sets ON/OFF of an automatic cassette changing function, change in set time until the mode enters an energy saving mode, etc. Reference numeral 450 is denotes a transparent mode selection key, Reference numeral 451 denotes a both-side mode selection key, reference numeral 452 denotes a full-color mode selection key, and reference numeral 453 denotes a monochromatic (single color) mode selection key. When the transparent mode selection key 450 is not pressed, the image forming apparatus is in a mode in which the image forming operation is performed in a non-transparent mode in which the transparent toner is not used. When the key 450 is pressed, the image forming apparatus is placed in the transparent mode in which the color toners and the transparent toner are used, so that a touch panel (setting buttons) for gloss selection is displayed at the liquid crystal display portion 406 as shown in FIG. 4(*a*). By this touch panel, the user can further select a medium gloss mode (first transparent mode) or a high gloss mode (second transparent mode) in the transparent mode. When the medium gloss mode (first transparent mode) is selected, the image forming apparatus is placed, as described above, in the mode in which the transparent image using the transparent toner is fixed by only the fixing device F1. Further, when the high gloss mode (second transparent mode) is selected, the image forming apparatus is placed, as described above, in the mode in which the transparent image is fixed by the fixing device F1 and then is further fixed by the fixing device F2.

<Fixing Device F1>

With reference to FIG. 3(*a*), a constitution of the heat roller fixing device F1 as the first fixing means will be described. Reference numerals 51 and 52 are a fixing roller and a pressing roller, respectively, which are rotatable members rotatably supported by bearings. The rollers are vertically arranged in parallel to each other and are caused to press-contact each other, so that the fixing nip N is formed. The roller 51 employs a concentric three-layer structure including a core portion 51*a*, an elastic layer 51*b*, and a parting layer 51*c*. The core portion 51*a* is constituted by a hollow aluminum pipe which is 44 mm in diameter and 5 mm in thickness. The elastic layer 51*b* is constituted by a silicon rubber which is 50 degrees in JIS-A hardness and 2.5 mm in thickness. The parting layer 51*c* is constituted by a 50 μm-thick film of PFA. A halogen lamp H1 as a heat source (roller heating heater) is provided inside the hollow pipe of the core portion 51*a*.

The pressing roller 52 also has the three-layer structure, similarly as in the case of the roller 51, including a core portion 52*a*, an elastic layer 52*b*, and a parting layer 52*c*. However, as the elastic layer 52*b*, a 3 mm-thick silicon rubber layer is used. This is because a greater width of the nip N can be ensured by the elastic layer 52*b*. Reference character H2 denotes a halogen lamp which is provided, as the heat source (roller heating heater), in the hollow pipe of the core portion 52*a* of the roller 52. The roller 51 and the roller 52 are pressed against each other with a predetermined urging force, so that the nip N as a heating and pressing portion having a predetermined width with respect to the recording material conveyance direction is formed. In this embodiment, the urging force of the roller 52 was 490 N (50 kgf). At this time, the width of the nip N was 7 mm. The roller 51 and the roller 52 are rotationally driven by a driving motor (not shown) in the direction indicated by arrows while press-contacting each other. The heaters H1 and H2 generate heat by being supplied with electric power from power source circuits Q1 and Q2 (FIG. 2B), respectively. The roller 51 and the roller 52 are heated from the inside by the heat generated by the heaters H1 and H2, respectively. The power ratings of the heaters H1 and H2 are 800 W and 500 W, respectively. The surface temperatures of the roller 51 and the roller 52 are monitored by temperature sensors TH1 and TH2, which are thermistors or the like brought into contact with the surfaces of the heaters H1 and H2, respectively. The electrical information on the detected temperatures is input into a fixation control portion K1 of the controller K. The control portion K1 controls the electric power supplied from the power source circuits Q1 and Q2 to the heaters H1 and H2, on the basis of the input information, so that the surface temperatures (fixation temperatures) of the roller 51 and the roller 52 are maintained at predetermined control temperatures (target temperatures). That is, the roller 51 and the roller 52 are temperature-controlled at the predetermined control temperatures to control the temperature of the nip N.

Reference numeral 54 denotes a web type cleaning device for cleaning the surface of the roller 51. Reference numeral 55 denotes a web-type cleaning device for cleaning the surface of the roller 52. The web is a heat resistant cleaning member. The roller 51 and the roller 52 are rotationally driven and are internally heated by the heaters H1 and H2 so that their surface temperatures are increased to the predetermined control temperatures and maintained at the predetermined control temperatures. In this state, the recording material P on which unfixed toner images have been formed is introduced into the fixing device F1 by the belt 12 from the mechanism D side. In a process in which the recording material P enters and is nip-conveyed through the nip N, the recording material P is heated and pressed with nip pressure by the rollers 51 and 52. As a result, in the transparent mode, multiple toner images of Y, M, C and Bk and transparent (T) are fixed as a full-color image on the surface of the recording material P. The recording material P which has come out of the fixation nip N is separated from the roller 51 or the roller 52 by a separation claw (not shown), is relayed by the fixation sheet discharging rollers 56, and then is sent from the fixing device F1. A releasing agent applying device 53 applies silicone oil to the surface of the roller 51 to prevent the toner from deposit on the surface of the roller 51 during passing of the recording material P through the nip N. The cleaning devices 54 and 55 remove the toner which has offset onto the surfaces of the roller 51 and the roller 52, respectively.

<Fixing Device F2>

With reference to FIG. 3(*b*), the belt fixing device F2 as the second fixing means will be described. The fixing device F2 is capable of fixing the image with glossiness which is higher than that by the fixing device F1 as described above. The fixing device F2 includes a fixing roller 71, a separation roller 73 which is provided while being kept at a predetermined interval from the fixing roller 71, and a tension roller 74 provided above the roller 73. The fixing device F2 further includes an endless fixing belt 77 which is extended around and stretched by these three rollers 71, 73 and 74. Further, the fixing device F2 includes a pressing roller 72 which opposes the roller 71 and presses the belt 77 against the roller 71. Further, the fixing device F2 includes an auxiliary roller 75 provided in contact with an outer surface of the belt 77 at a position close to the roller 73 at a belt portion between the roller 71 and the roller 73. Further, the fixing device F2 includes a cooling fan 76 (cooling means), for air-cooling the belt portion between the roller 71 and the roller 73, which is provided inside the belt 77 and is disposed between the roller 71 and the roller 73. The above-described rollers 71, 72, 73, 74 and 75 are arranged in substantially parallel to each other.

The roller 71 is employs a concentric three-layer structure including a core portion, an elastic layer, and a parting layer. The core portion is constituted by a hollow aluminum pipe which is 44 mm in diameter and 5 mm in thickness. The elastic layer is constituted by a silicon rubber which is 30 degrees in JIS-A hardness and 300 μm in thickness. The parting layer is constituted by a 50 μm-thick film of PFA. A halogen lamp 78 as the heat source (roller heating heater) is provided inside the hollow pipe of the core portion.

The pressing roller 72 also has the same constitution. However, as the elastic layer, a 3 mm-thick silicon rubber layer is used. This is because a greater width of a fixation nip N can be ensured by the elastic layer 52*b*. Reference numeral 79 denotes a halogen lamp which is provided, as the heat source (roller heating heater), in the hollow pipe of the core portion of the roller 72. The roller 71 and the roller 72 press the belt 77 against each other with a predetermined urging force, so that the nip N as a heating and pressing portion having a predetermined width with respect to the recording material conveyance direction is formed. In this embodiment, the urging force of the roller 72 was 980 N (100 kgf) as a total pressure. At this time, the width of the nip N was 10 mm. Here, a surface hardness of the roller 71 is required to be selected corresponding to the belt 77. When the surface hardness of the roller 71 is small, the belt 77 is bent, so that the toner cannot be pushed into a (toner) receiving layer of the recording material P and thus a stepped toner portion is left as it is. In the case where the hardness of the belt 77 is small, in order to sufficiently harden the roller 71, it is also possible to form the elastic layer in a small thickness or form the surface layer of PFA without forming the elastic layer or use only the aluminum core as the roller 71. The roller 71 is rotationally driven in the clockwise direction indicated by an arrow by a driving mechanism (not shown) at a predetermined speed. By this rotational drive of the roller 71, the belt 77 is placed in a rotational movement state in the clockwise direction indicated by arrows. The rollers 73, 74, 72 and 75 are rotated by the rotation of the belt 77. The roller 74 applies a predetermined tension to the belt 77. The electric power is supplied to the lamps 78 and 79 which are provided inside the rollers 71 and 72, respectively, so that the rollers 71 and 72 are internally heated by the heat generated by the lamps 78 and 79 and thus the surface temperatures of the rollers 71 and 72 are increased. The surface temperatures of the rollers 71 and 72 are detected by thermistors (not shown), respectively. The detected temperatures of the thermistors are fed back to a fixation control portion K2 of the controller K. The control portion K2 controls the electric power supplied to the lamps 78 and 79 so that the detected temperatures input from the respective thermistors are maintained at predetermined control temperatures set for the rollers 71 and 72, respectively. That is, the rollers 71 and 72 are temperature-controlled at the predetermined control temperatures to control the temperature of the nip N at a predetermined fixing temperature. The recording material P sent to the fixing device F2 side is introduced into the nip N between the belt 77 and the roller 72 and is nip-conveyed through the nip N. The toner image surface of the recording material P faces the surface of the belt 77. In a process in which the recording material P is nip-conveyed through the nip N, the recording material P is heated and pressed, so that the toner images are fixed on the recording material P. At the same time, the recording material P intimately contacts the surface of the belt 77. Thereafter, in a state in which the recording material P intimately contacts the belt 77, the recording material P is conveyed in a cooling area (cooling portion) R between the nip N and the roller 73 by the rotation of the belt 77. In this cooling area R, the recording material P is forcedly cooled efficiently by a cooling fan 76 and by the action of the air flowing the inside of an air duct 76*a* surrounding the cooling fan 76. By the cooling fan 76, the air flow is generated in a direction perpendicular to the drawing sheet of FIG. 3(*b*). In this way, the recording material P in the state in which the recording material P intimately contacts the surface of the belt 77 is sufficiently cooled in the cooling area R to reach the position of the roller 73 and is (curvature-)separated from the surface of the belt 77 by its own rigidity (flexibility) in an area in which the curvature of the belt 77 is changed by the roller 73. At this time, the toner images are solidified by following a mirror surface-like belt surface shape and thus the entire surface of the recording material P is made smooth, so that it is possible to obtain an image superior in glossiness than that by the fixing device F1. The roller 75 prevents the recording material P from being separated from the surface of the belt 77 to cause image defect and failure in conveyance. The cooling means 76 is not limited to the fan but may also be of a contact cooling type. It is also possible to use Peltier element, a heat pipe, and a water circulation type cooling device. As described above, the second fixing means F2 includes the fixing belt and the cooling means and it is desirable that the temperature at which the recording material P is separated from the fixing belt 77 is not more than a temperature which is higher than a glass transition point of the toner by 20° C. Generally, plastics and fibers have crystallinity. On the other hand, rubbers (elastomers) have no crystalline structure and have only a non-crystalline portion, so that the rubbers show large extensibility and maintain their structures by a cross-linking structure by which passing of molecules is prevented. The non-crystalline portion of polymeric materials also shows low molecular mobility (glass state) when the temperature is low and shows high molecular mobility (rubber state) when the temperature is increased. The temperature of a boundary between the glass state and the rubber state is referred to as the glass transition point Tg which is measured in accordance with JIS K7121 (Testing Methods for Transition Temperatures of Plastics).

As the color toners in this embodiment, polyester resin toners were used. The toners were manufactured by a pulverization method. As the toner manufacturing method, suspension polymerization, interfacial polymerization, dispersion polymerization, or the like, that is, the toner manufacturing methods in which the toner is directly manufactured in a medium, is also preferable. The ingredients and method for producing the toners are not limited to those mentioned above. In the manufacturing method of the transparent toner, the same polyester resin as in the case of the color toners was used but the transparent toner was produced without mixing a color pigment. The glass transition point (Tg) is not particularly limited. When the type or molecular weight of the resin material for the transparent toner is changed, a melting characteristic is changed, so that different glossiness values are obtained even under the same fixing condition. Therefore, a polyester resin which is lower in glass transition point (Tg) and which is easier to melt, than a polyester resin used as the material for the color toners, can be used for manufacturing the transparent toner so that the transparent toner can be used as a toner which is glossier after fixation than the color toners. Instead, a polyester resin which is higher in glass transition point (Tg) and which is, more difficult to melt, than a polyester resin used as the material for the color toners, can be used as the material for the transparent toner which has low glossiness. Incidentally, the transparent toner is not necessarily transparent. The transparent toner may also be formed of the polyester resin which is yellowish transparent. The transparent toner is white in an unfixed state. This is because the toner which has been pulverized to have a particle size of about 5-10 μm causes scattering of most of light at its surface and is very low in the amount of light transmission, thus appearing white. Therefore, in the case where energy applied to the toner for the fixation is small, the transparent toner does not sufficiently become transparent but can appear whitish. Even in such a state, it can be said that a quality is satisfied when the transparent toner has target glossiness without being separated (from the recording material).

<Image Information>

The image information includes color information and brightness information every pixel. A binary (two-value) image and a multi-value image mean an image which is represented by the number of data of the brightness information. The binary image means an image in which all the pieces of the brightness information are replaced with two values. On the other hand, the multi-value image means all the images except the binary image. Generally, an image represented by "8-bit format" is frequently used as the multi-value image. Generally, the binary image is represented by "1 or 0" in terms of the data and in other words, the binary image is represented by "1-bit format". The 8-bit format includes 8 bits, i.e., eight consecutive one-bits and can provide representation at 2 raised to the 8th power (=256) levels. In the case of the 8-bit format image, when the image is represented by 256 colors, the image is called "256 color image". Further, when the image is represented by white and black and by 256 shades (tones) of gray, the image is called "gray scale image". Further, on a computer, the color is represented by a combination of "R (red), G (green) and B (blue) which is so-called the three primary colors. Each of the three primary colors is classified into 256 tone gradation levels, representation by 256 colors raised to the third power (=16,770,000 colors) is provided. This is generally called "full color". The image information of the transparent toner is treated as the image information for one color. That is, the gray scale image or the white and black binary image is output by being replaced with the transparent toner, not the black. It is also possible to treat the color images. In this case, the color images of RGB or C (cyan) M (magenta) Y (yellow) K (black) are output by being converted into the gray scale including only the brightness information. This will be described more specifically below but binary image formation with the transparent toner means that two-tone-gradation representation is effected. In the case where the transparent toner is caused to meet the output of the multi-value image, the amount of the transparent toner is not required to meet a minimum toner amount and a maximum toner amount. The two tone gradation representation is provided by two tone gradation levels consisting of a portion of "zero" and a portion of "60%". In the image forming apparatus in this embodiment, the transparent toner image forming portion is capable of outputting the image with 400 dpi and 256 tone gradation levels.

<Grossing Glossing Device F2 and Transparent Toner Amount>

The case of the image defect assumed by the present inventor will be briefly described. When the area in which the image of the transparent toner in an amount per unit area which is less than a predetermined amount per unit area has been formed on the sheet is subjected to glossing (process), the image defect in the area appears to be bubbles or cavities. The present inventor considered that this image defect is caused by an extreme glossiness difference, between the image defect area and an area except the image defect area on the sheet processed by the glossing device, varying depending on the transparent toner amount (per unit area). Actually, when the transparent toner image is formed in accordance with the image data for transparent designated by the user, an area, including an area in which the glossiness is extremely high (glossiness of about 100) and an area in which the glossiness is low (glossiness of about 30) which are locally created, appears to be bubbles.

<Proper Use of Fixing Devices F1 and F2>

Figure 5:
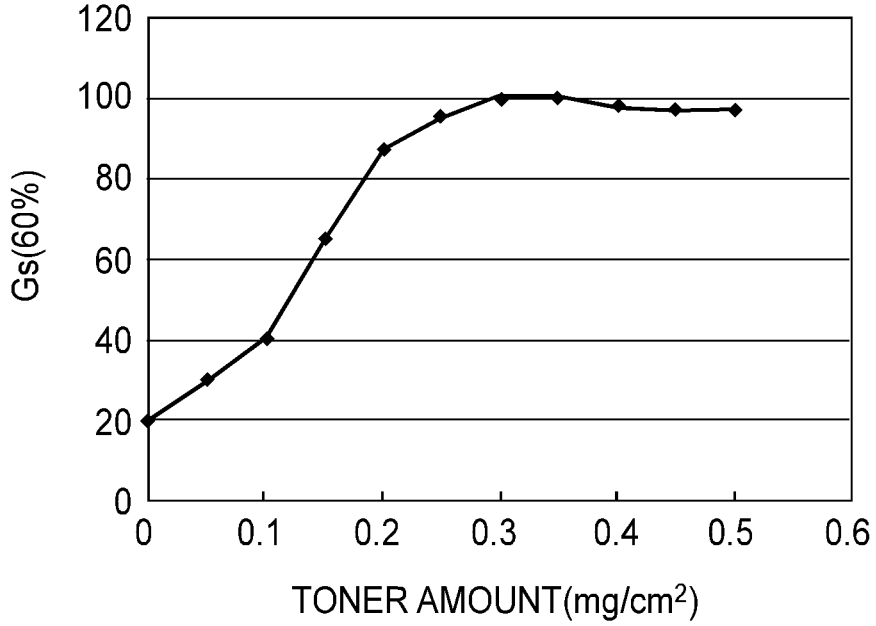
FIG. 5(*a*) is a graph showing a relationship between the toner amount and the glossiness with respect to the fixing device F2 in Embodiment 1, and FIG. 5(*b*) is a flowchart of conversion from multi-value image data into a binary image data in Embodiment 1.
Figure 5:
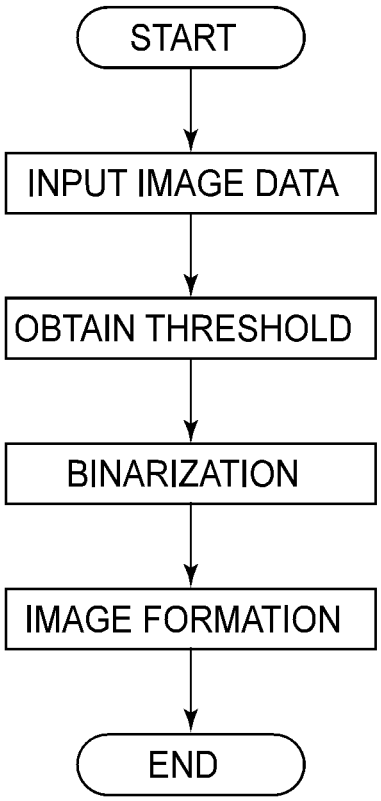

The fixing device F1 is used in the case where the user wishes to make a marking with medium gloss-transparent toner providing the glossiness of about 30-50%. The marking may be made partly or on the entire surface with the transparent toner. The fixing device F2 is used after the use of the fixing device F1 in the case where the user wishes to provide a toner portion with high glossiness of about 90-100%. In such a constitution, a change in glossiness with a change in toner amount (per unit area) during passing of sheets through the fixing device F1 is shown in FIG. 4(*b*). The glossiness was measured at an angle of 60 degrees by using a handy gloss meter ("PG-1M", mfd. by Nippon Denshoku Co., Ltd.) in accordance with JIS Z8741 (Specular Glossiness-Methods of measurement). By using such an image forming apparatus, image formation is effected. The process speed was 200 mm/sec, the controlled temperature was 155° C., and the recording material used was "U-light" (mfd. by Nippon Paper Industries Co., Ltd.; basis weight=157 g/m$^2$). The glossiness of the transparent toner is gradually increased until the toner amount reaches 0.5 mg/cm$^2$. Next, under the same toner amount condition, the change in glossiness in the case where the sheets are passed through the fixing device F2 after being passed through the fixing device F1 is shown in FIG. 5(*a*). In the fixing device F2, the process speed was 100 mm/sec and the controlled temperature was 140° C. This results shows that the glossiness is maximum at the toner amount (per unit area) of 0.3 mg/cm$^2$. Therefore, as the transparent toner amount necessary to enhance the glossiness, 0.3 mg/cm$^2$ is sufficient. Further, such a problem that cracking of the toner layer was liable to occur when the toner amount was increased in excess of 0.3 mg/cm$^2$ arose. Therefore, in the case of a multi-value transparent (toner) image which is to be passed through only the fixing device F1 (a medium gloss mode (first transparent mode)), a maximum toner amount is taken as 0.5 mg/cm$^2$ and the toner amount is treated as the multi-value data having 256 tone gradation levels so that the user can change the glossiness depending on his (her) liking. Incidentally, in the medium gloss mode, a minimum toner amount is 0.002 (=0.5/255) mg/cm$^2$. Further, in the case of a high gloss mode (second transparent mode), the image data was treated as the binary data and the toner amount at a pixel where the image formation was effected was 0.3 mg/cm$^2$. That is, in the case where the fixing device F2 is not used in the transparent mode in which the image is formed by using the transparent toner, the glossiness can be changed and therefore the image data is treated as the multi-value data with respect to the multi-value transparent image. In the case where the transparent image is passed through the fixing device F2, the image data is treated as the binary data. That is, the image forming apparatus includes a converting means for converting the multi-value transparent image data, to be subjected to the image formation using the transparent toner, into the binary image data. In the case of the medium gloss mode (first transparent mode), the image formation using the transparent toner is effected by using the multi-value transparent image data. In the case of the high gloss mode (second transparent mode), the image formation using the transparent toner is effected by using the binary transparent image data.

Figure 6:
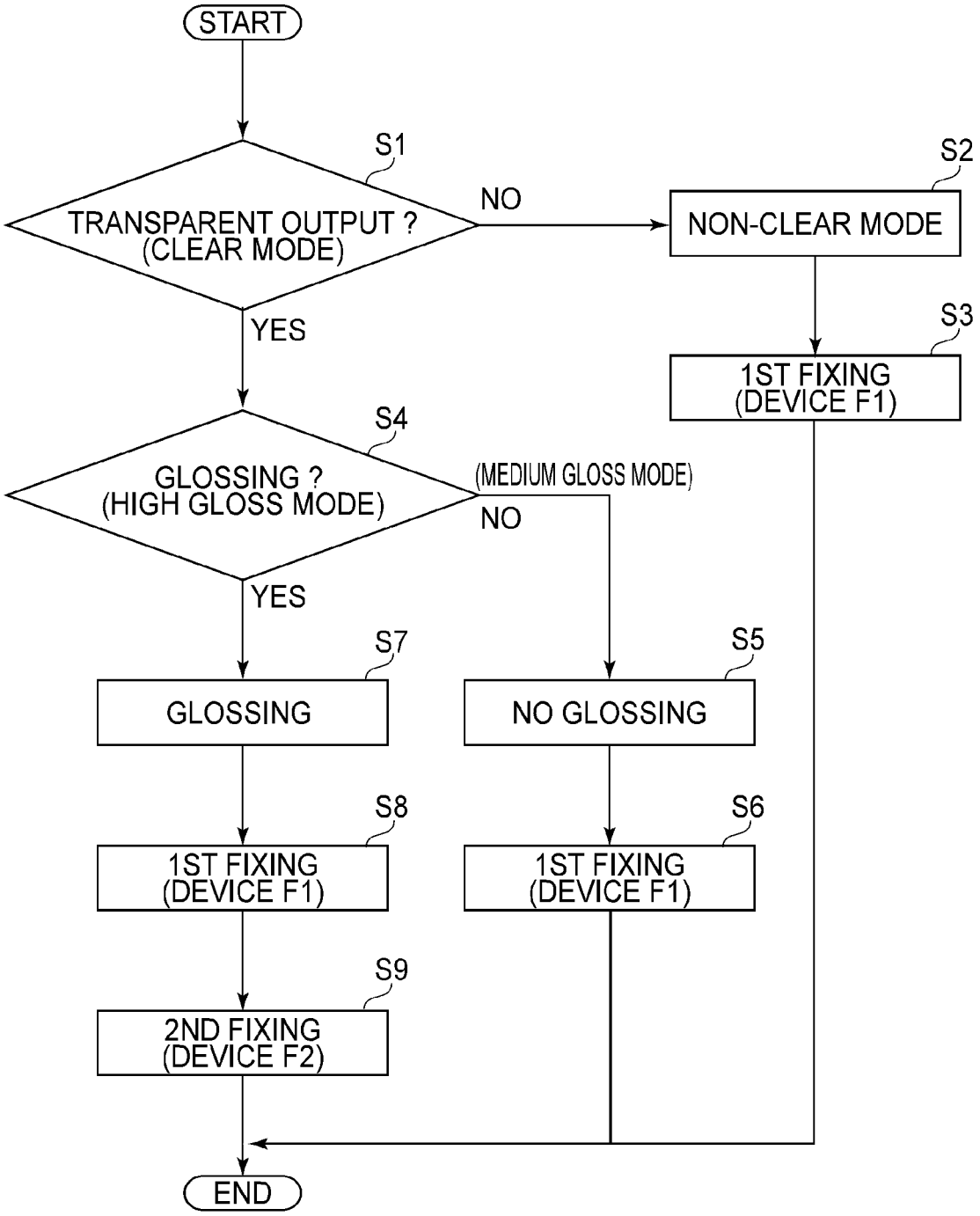
FIG. 6 is a control flowchart in Embodiment 1.
Figure 7:
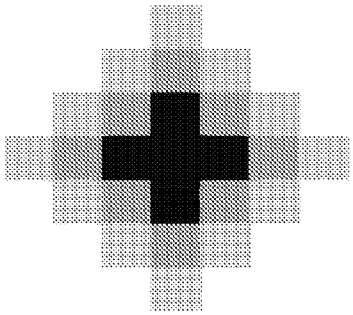
FIG. 7(*a*) is an example of a multi-value image, FIG. 7(*b*) is an example of a binary image converted from the multi-value image, and FIG. 7(*c*) is an example of a look-up table.
Figure 7:
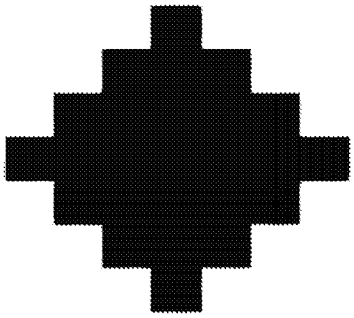
Figure 7:
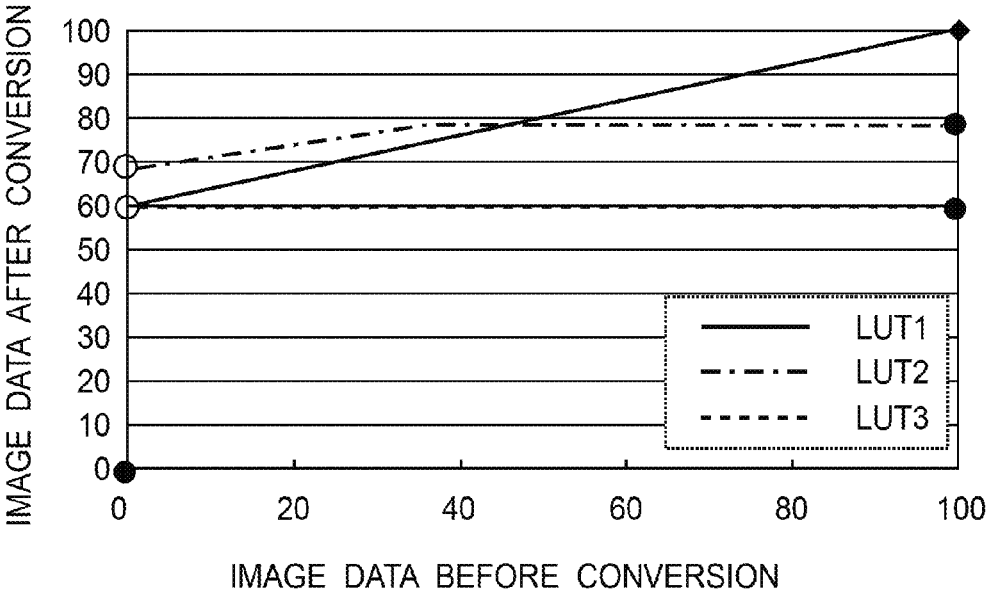

Along a flowchart of FIG. 5(*b*), the portion for converting the multi-value data into the binary data will be described more specifically. The controller K subjects the multi-value image, input from an image inputting portion, to the binarization on the basis of a threshold in synchronism with an address signal to be image-input, thus converting the multi-value image into the binary image. Further, the controller K outputs the binarized image, as an output image data, to an image formation control means. In this case, the converting means for converting the multi-value image into the binary image is constituted as described above. By such a converting means, e.g., the multi-value image as shown in FIG. 7(*a*) is converted into the binary image as shown in FIG. 7(*b*). In the controller K shown in FIG. 2B, reference character K3 represents a functioning portion as the converting means for converting the multi-value image into the binary image. FIG. 6 is an operation flowchart in the transparent mode (clear mode) and in the non-transparent mode (non-clear mode) in this embodiment. When the transparent mode selection key 450 (FIG. 2B) is not pressed, the image forming apparatus performs the image forming operation in the non-transparent mode in which the transparent toner is not used (steps S1 and S2). The recording material subjected to the toner image formation in this mode is subjected to image fixation only by the fixing device F1 (S3) and then is discharged onto the first discharging tray 65. The image forming apparatus is placed in the transparent mode in which the color toners and the transparent toner are used by pressing the key 450, so that the touch panel (setting buttons) for selecting the gloss modes as shown in FIG. 4(*a*) is displayed. The user can select the medium gloss mode (first transparent mode) or the high gloss mode (second transparent mode) on this touch panel (S4). When the medium gloss mode (first transparent mode) is selected, the image forming apparatus is placed in the mode in which the image is fixed only by the fixing device F1. Further, in the case where the fixing device F2 is not used, the glossiness can be changed and therefore in this case, the controller K treats the image data as the multi-value image data with respect to the multi-value transparent image. That is, the transparent toner image is formed in a toner amount for no glossing (S5). The recording material on which the toner image has been formed in this mode is subjected to image fixation only by the fixing device F1 (S6) and then is discharged onto the first discharging tray 65, so that the recording material is not introduced into the fixing device F2. When the high gloss mode (second transparent mode) is selected, the image forming apparatus is placed in the mode in which the image is fixed by the fixing device F1 and then by the fixing device F2. In this case, the controller K binarizes the multi-value image with respect to the transparent image, thus converting the multi-value image into the binary image. That is, the transparent toner image is formed in a toner amount for glossing (S7). When the multi-value image is binarized, the brightness information of a pixel is compared with a preset threshold and then the image data is written into 0 and 1 depending on whether or not the brightness information is larger or smaller than the threshold. For example, 256 tone gradation data is subjected to comparison such that the value thereof is larger or smaller than 50, thus being binarized. Then, a portion represented by 1 is set at 156 corresponding to 60% of the 256 tone gradation and then the transparent toner image formation is effected. That is, the binary image used for outputting the transparent toner image in this embodiment provides a binary (two-value) transparent toner image by the 256 tone gradation multi-value image constituted by 0 and 154. The recording material on which the image has been formed in this mode is subjected to the image fixation by the fixing device F1 (S8) and then subjected to the image fixation by the fixing device F2 (S9), and then is discharged onto the second discharging tray 70. In the high gloss mode (second transparent mode), by converting the image data as described above with respect to the transparent image, it was possible to provide the image forming apparatus free from occurrences of the image defect and the cracking of the toner layer.

Here, the multi-value image is converted into the binary image but a look-up table (LUT) may also be changed so that a density range in which the image defect is caused by the fixing device F2 cannot be output in the half-tone area. That is, as shown by "LUT 1" in FIG. 7(*c*), the image data may also be converted so that the output of 60% or less cannot be performed (i.e., in the case where the image is fixed by the second fixing means F2, the image data may also be converted so that the image formation cannot be effected with the toner amount which is not more than a certain value).

Here, in the case where the toner image is processed by the glossing device, the amount per unit area of the transparent toner (corresponding to the image data) is not limited to that corresponding to 60% (first threshold). The cause of the image defect which appears to be bubbles is that the sheet processed by the glossing device causes an extreme glossiness difference depending on the transparent toner amount (per unit area) FIG. 5(*a*)). For that reason, in order to suppress the occurrence of the image defects such as the bubbles in the case of using the glossing device, the transparent toner image may be formed on the sheet in an amount within a range in which the change in glossiness with respect to the toner amount is saturated (i.e., there is substantially no change). In a specific example, in the case where the recording material is "U-light" (basis weight=157 g/m$^2$) manufactured by Nippon Paper Industries Co., Ltd., in the range from about 0.3 mg/cm$^2$ to about 0.5 mg/cm$^2$ (from 60% to 100% of the 256 tone gradation), the glossiness is about 100±5 and thus is not substantially changed (FIG. 5(*a*)). For that reason, in order to suppress the image defect, the transparent toner image may be formed in the toner amount of 0.3 mg/cm$^2$ (60%) or more in an area, designated by the user, in which the transparent toner is to be formed. Incidentally, the glossiness change with the change in toner amount varies depending on the recording material. For that reason, the range in which the glossiness change is saturated is less than 60% depending on the type of the sheet in some cases.

Therefore, a detecting portion for detecting the type of the sheet on which the transparent toner image is to be formed is provided and the threshold may also be changed depending on the detected type of the sheet. Further, in the case of performing the glossing, when the amount of the toner to be formed on the sheet is excessively large, it has found that an output print is more difficult to fold. Therefore, in order to address these problems, a conversion table such as "LUT 2" shown in FIG. 7(*c*) is used. Specifically, in the case of using "U-light (basis weight=100 g/m$^2$) manufactured by Nippon Paper Industries Co., Ltd. as the recording material, the glossiness change saturation range with respect to the toner amount was between 70% and 100%. Further, in the case where the transparent toner image is formed in the toner amount corresponding to 90% or more (of the 256 tone gradation), the print is more difficult to fold. For that reason, in "LUT 2" an upper limit (80%) was provided with respect to the toner amount.

Here, the controller obtains the type of the sheet by a media sensor for detecting the type of the sheet (paper) or obtains the type of the sheet designated by the user, and switches the LUT used for forming the transparent toner image depending on the obtained type of the sheet (paper).

Incidentally, the LUT at the time when the multi-value image data is converted into the binary image data is equivalent to "LUT 3" in FIG. 7(*c*). By converting the multi-value data into the binary data, the amount of data becomes small, so that a load during communication between devices (apparatuses) is reduced.

Incidentally, the operation of the image forming apparatus as a copying machine is described above but a similar effect is obtained also in the case of using the image forming apparatus as a printer.

As described above, it was possible to provide an image forming apparatus capable of forming a good image with respect to each of the plurality of the fixing devices F1 and F2 different in glossiness of the output product. That is, in an image forming system using the transparent toner and the glossing device, the transparent toner amount was able to be optimized.

Embodiment 2

Figure 8A:
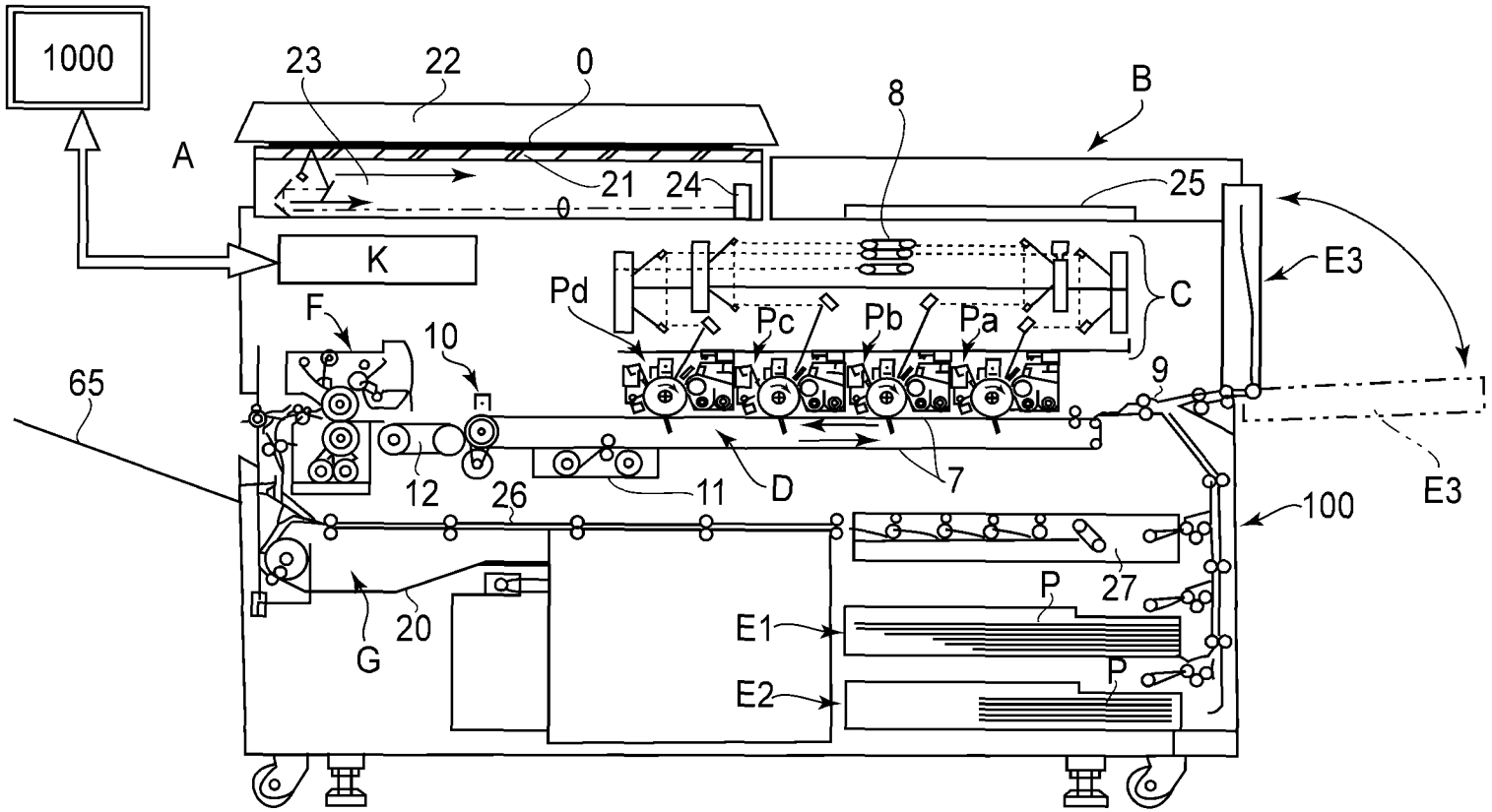
FIG. 8A is a schematic view showing a structure of a color image forming apparatus in Embodiment 2.
Figure 8B:
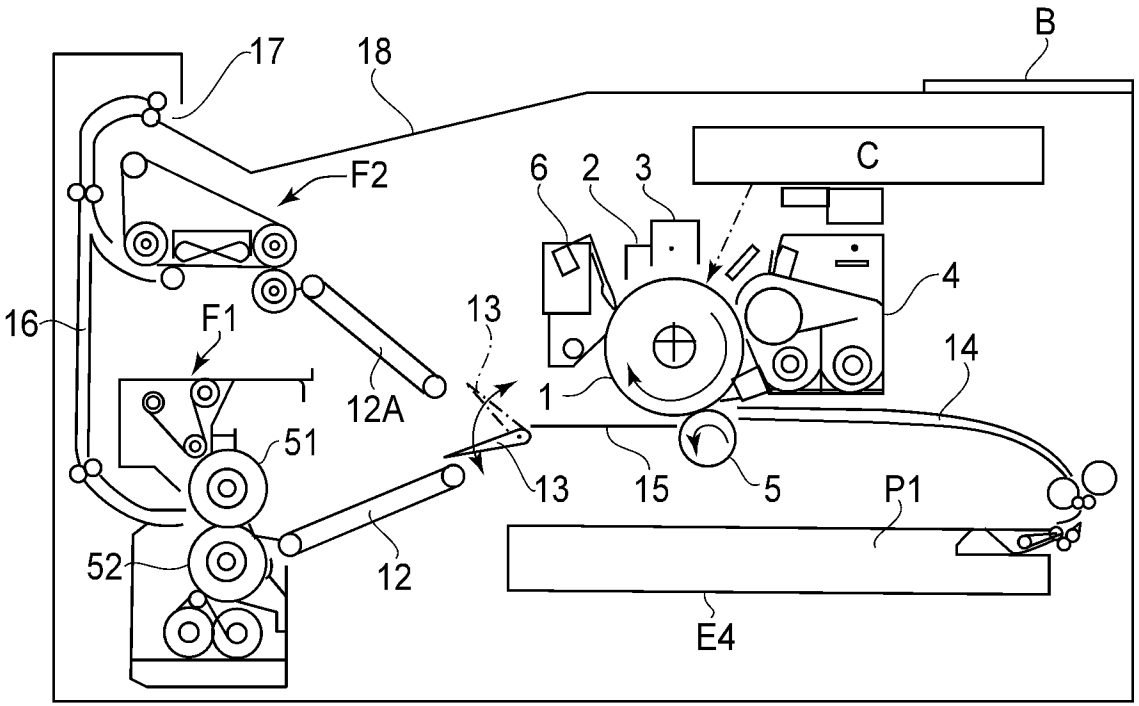
FIG. 8B is a schematic view showing a structure of a transparent image forming apparatus.

In the image forming system in this embodiment, a full-color image forming apparatus as shown in FIG. 8A was used for first image formation and fixation in which the image was formed with the color toners and then was fixed. Further, a (single-color) transparent image forming apparatus as shown in FIG. 8B was used for second image formation and fixation in which the image was formed with the transparent toner and then was fixed. The full-color image forming apparatus of FIG. 8A has a constitution in which the fifth image forming portion which is the image forming portion using the transparent toner is removed from the image forming apparatus in Embodiment 1 and is operated in the non-transparent mode similarly as in Embodiment 1. As the fixing device in the full-color image forming apparatus of FIG. 8A, the heat roller fixing device identical to that in the image forming apparatus in Embodiment 1 was used. The transparent image forming apparatus of FIG. 8B is an electrophotographic image forming portion having the same constitution as that of the fifth image forming portion Pe which is the image forming portion for forming the transparent toner image in the image forming apparatus in Embodiment 1. Into the developing device 4, the transparent toner is supplied from a supplying device. The image forming apparatus of FIG. 8B includes the heat roller fixing device F1 as the first fixing means and the belt fixing device F2 as the second fixing means. As the transparent toner, a toner which was produced by the suspension polymerization was used. The toner contains a wax as a parting agent, so that oil is not applied onto the fixing roller 51 of the heat roller fixing device F1 as the first fixing means. With respect to the glass transition temperature (point) (Tg), the transparent toner had the glass transition temperature (Tg) which was higher than those of the color toners. As a result, on the image after the image formation using the transparent toner is effected, the glossiness of the transparent toner was higher than that of the color toners. In this embodiment, by the full-color image forming apparatus of FIG. 8A, a non-transparent full-color image or a non-transparent monochromatic image is formed. Further, in the case where the resultant print is further output as a transparent image-formed product, a recording material P1 which has already been subjected to the non-transparent image formation and then has been output onto a discharging tray 65 (FIG. 8A) (i.e., the recording material which has already been subjected to the first image formation and fixation) is accommodated in a sheet feeding cassette E4 of the transparent image forming apparatus of FIG. 8B. Then, at an operating display portion B, selection of the medium gloss mode (first transparent mode) or the high gloss mode (second transparent mode) and settings of other desired image forming conditions are made and then the image forming operation is started. One of the sheets of the recording material P1 in the sheet feeding cassette E4 is separated and fed and there is sent to the transfer portion of the image forming portion through a sheet path 14. As a result, the image formation using the transparent toner is effected on the full-color image-formed surface or the monochromatic image-formed surface of the recording material. In the case where the medium gloss mode (first transparent mode) is selected, the recording material which has come out of the transfer portion is separated from the drum 1 and passed through a sheet path 15 and then is turned toward the fixing device F1 side by a flapper 13 which has been switched into a first attitude indicated by a solid line. As a result, the recording material is introduced into the fixing device F1 by a conveyer belt 12, thus being subjected to the fixation. Then, the recording material is passed through a sheet path 16 and is discharged from a discharging opening 17 onto a discharging tray 18. That is, a transparent image-formed product with medium glossiness is output. Further, in the case where the high gloss mode (second transparent mode) is selected, the recording material which has come out of the transfer portion is separated from the drum 1 and passed through the sheet path 15 and then is turned toward the fixing device F2 side by the flapper 13 which has been switched into a second attitude indicated by a chain line. As a result, the recording material is introduced into the fixing device F2 by a conveyer belt 12A, thus being subjected to the fixation (second image formation and fixation). Then, the recording material is passed through the sheet path 16 and is discharged from the discharging opening 17 onto the discharging tray 18. That is, a transparent image-formed product with high glossiness is output. Also in such a constitution, in the case of the transparent image which was passed through only the fixing device F1, the glossiness was changed until the toner amount reached 0.4 mg/cm$^2$. Further, in the case of the transparent image which was passed through the fixing device F2, the glossiness was stabilized at the toner amount of 0.3 mg/cm$^2$. Therefore, also in such a constitution, in the case of the transparent image which was passed through the fixing device F1, the maximum toner amount was taken as 0.4 mg/cm$^2$ and the image data was treated as the 256 tone gradation multi-value image data. In the case of the transparent image which was passed through the fixing device F2, the image data was treated as the binary data and the toner amount at a pixel where the image formation was effected was set at 0.3 mg/cm$^2$. In this embodiment, as the fixing device F1, a fixing device using a roller pair which was prepared by coating a rubber with a PFA tube was used. However, the fixing device F1 is not limited thereto but an effect can also be achieved by using a fixing device using a fixing belt or a belt fixing device using a pressing belt in place of the pressing roller. As described above, also in this constitution, it was possible to provide the image forming apparatus capable of forming the good image with respect to each of the plurality of the fixing devices F1 and F2 different in glossiness of the output product.

Embodiment 3

Figure 9:
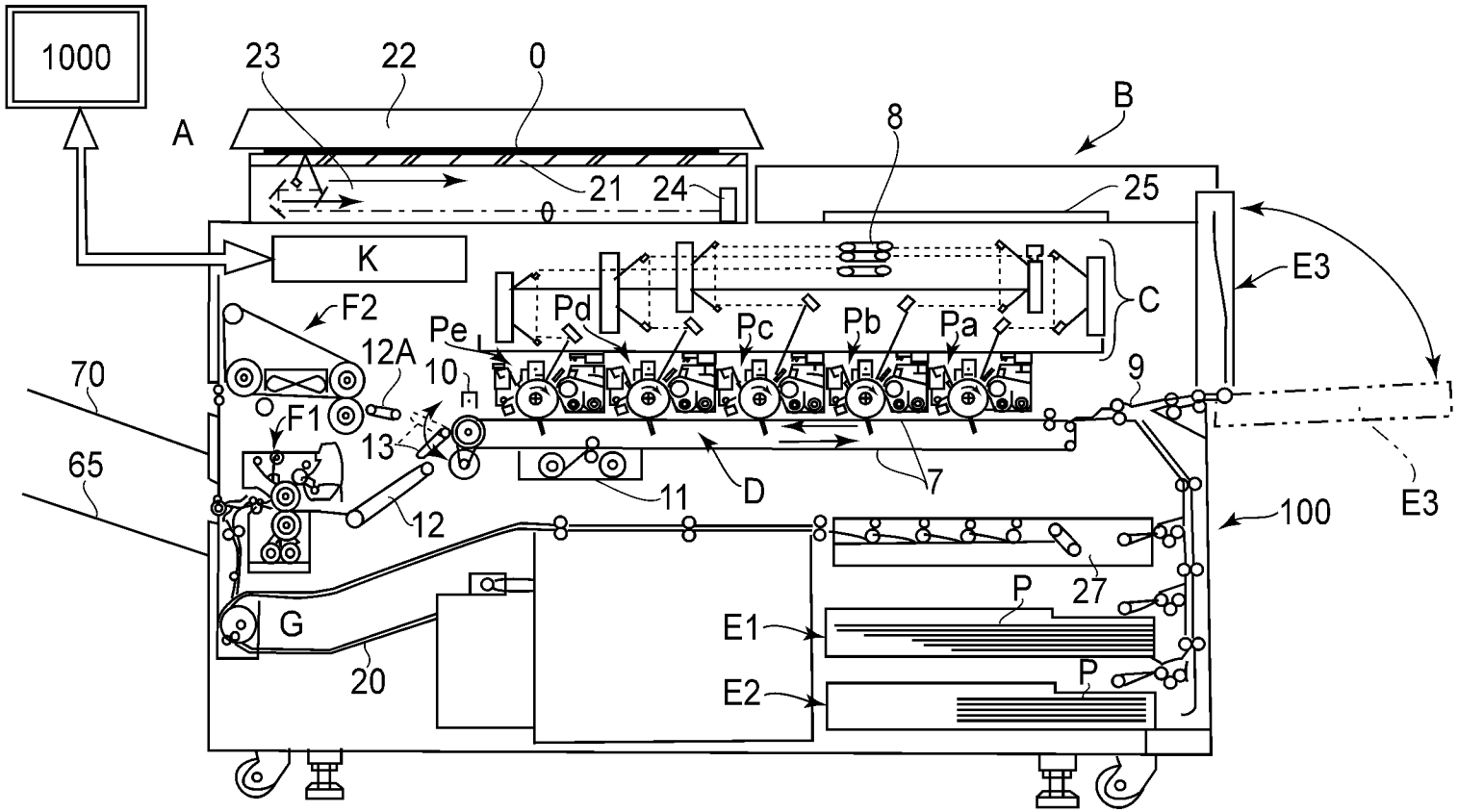
FIG. 9 is a schematic view showing a structure of a color image forming apparatus in Embodiment 3.

FIG. 9 is a schematic structural view of the image forming apparatus (image forming system) in this embodiment. Constituent members or portions common to the image forming apparatus in this embodiment and the image forming apparatus in Embodiment 1 are represented by the same reference numerals or characters and are omitted from redundant description. In the image forming apparatus in this embodiment, on a downstream side of the belt with respect to the recording material conveyance direction, the belt fixing device F2 which is the first fixing means and the heat roller fixing device F2 which is the second fixing means are vertically provided. Further, in the case where the medium gloss mode (first transparent mode) or the non-gloss mode is selected, the recording material which has been separated from the belt 7 is turned toward the fixing device F1 side by the flapper 13 which has been switched into a first attitude indicated by a solid line. As a result, the recording material is introduced into the fixing device F1 by the conveyer belt 12, thus being subjected to the fixation, and then is discharged onto the first discharging tray 65. Further, in the case where the high gloss mode (second transparent mode) is selected, the recording material which has been separated from the belt 7 is turned toward the fixing device F2 side by the flapper 13 which has been switched into a second attitude indicated by a chain line. As a result, the recording material is introduced into the fixing device F2 by a conveyer belt 12A, thus being subjected to the fixation. Then, the recording material is discharged onto the second discharging tray 70. By employing such a constitution, the recording material is not passed through the fixing device F1 when the high gloss mode (second transparent mode) in which the fixing device F2 is used is selected. Also in such a constitution, when the medium gloss mode (first transparent mode) was set, the controller K controlled the transparent toner amount so that the transparent toner image was formed in the amount of 0.5 mg/cm$^2$ which was the setting for passing the transparent toner image through the fixing device F1. Further in the case where the high gloss mode (second transparent mode) was set, the controller K controlled the transparent toner amount so that the transparent toner image was formed in the amount of 0.3 mg/cm$^2$ and then was passed through the fixing device F2. Therefore, also in such a constitution, in the case of the transparent image which was passed through only the fixing device F1, the maximum transparent toner amount was taken as 0.5 mg/cm$^2$ and the image data was treated as the 256 tone gradation multi-value image data. Further, in the case of the transparent image which was passed through also the fixing device F2, the image data was treated as the binary data and the transparent toner amount at a pixel where the image formation using the transparent toner was effected was set at 0.3 mg/cm$^2$. Also in this constitution, it was possible to provide the image forming apparatus capable of forming the good image with respect to each of the plurality of the fixing devices F1 and F2 different in glossiness of the output product.

Other Embodiments

In Embodiment 1 to Embodiment 3, the method in which the toner image is formed on the recording material P (or P1) is not limited to the transfer type electrophotographic image forming method. The method may also be other image forming methods such as a direct type electrophotographic image forming method, an electrostatic recording method of the transfer type or the direct type, and a magnetic recording type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 222318/2009 filed Sep. 28, 2009 and 164687/2010 filed Jul. 22, 2010, which are hereby incorporated by reference.

What is claimed is:

1. An image forming apparatus comprising:

an image forming device configured to form a transparent image on a sheet using a transparent toner based on an inputted multiple-value image data;

a fixing device configured to heat-fix the image formed on the sheet;

a glossing device configured to increase a glossiness of the image, which is fixed by said fixing device, on the sheet;

a mode selector configured to select one of a first mode in which transparent image formation is performed using said fixing device and without using said glossing device, and a second mode in which image formation is performed using said fixing device and said glossing device; and a controlling device configured to control a toner amount per unit area of the transparent image to be formed on the sheet by said image forming device based on a mode selected by said mode selector, wherein when the first mode is selected, said controlling device makes said image forming device form the transparent image based on the inputted multiple-value image data, and wherein when the second mode is selected, said controlling device binarizes the inputted multiple-value image data to two-value image data and makes said image forming device form the transparent image based on the two-value image data.

2. The image forming apparatus according to claim 1, wherein said glossing device includes a belt configured to heat the transparent image on the sheet by contacting the transparent image, a roller configured to nip and convey the sheet cooperatively with said belt, and a cooling device configured to cool the transparent image on the sheet before the sheet is separated from said belt.

3. The image forming apparatus according to claim 2, wherein a temperature of said belt when the sheet is separated from said belt is not more than a temperature which is higher than the glass transition point by 20° C.

4. The image forming apparatus according to claim 1, further comprising a color image forming device configured to form a color image on the sheet using a yellow toner, a magenta toner, a cyan order and a black toner, wherein the transparent image is formed on the color image in the sheet.

* * * * *